United States Patent [19]

Steiner et al.

[11] 4,338,597

[45] Jul. 6, 1982

[54] REMOTE MONITOR INTERFACE

[75] Inventors: Gordon L. Steiner, Milford; David B. O'Keefe, Westford; Robert C. Miller, Braintree, all of Mass.

[73] Assignee: Honeywell Information Systems Inc., Waltham, Mass.

[21] Appl. No.: 127,671

[22] Filed: Mar. 6, 1980

[51] Int. Cl.[3] ..... G09G 1/00

[52] U.S. Cl. ..... 340/706; 340/744; 340/814

[58] Field of Search ..... 340/706, 802, 720, 744, 340/748, 814

[56] References Cited

U.S. PATENT DOCUMENTS

| | | | |
|---|---|---|---|
| 3,955,188 | 5/1976 | Viswanathan | 340/706 |
| 3,971,000 | 7/1976 | Cromwell | 340/706 |
| 4,143,360 | 3/1979 | Bernhart et al. | 340/706 |
| 4,149,145 | 4/1979 | Hartke et al. | 340/706 |

*Primary Examiner*—Marshall M. Curtis

*Attorney, Agent, or Firm*—William A. Linnell; Nicholas Prasinos

[57] ABSTRACT

A data processing system remote monitor interface includes a first device which transmits different types of time-related information signals along multiple parallel channels to a second device for reception and combination into a different number of information signal outputs. The different types of digital information signals are synchronized by the first device prior to transmission to the second device. Components in the first device, the multiple parallel channels, and the second device are selected to maintain signal synchronization by minimizing signal skew thereby eliminating the necessity for signal resynchronization in the second device. The second device includes a receiver section which has a plurality of receivers. Each receiver operates to receive only one digital information signal and to pass the received signal onto its output. The received digital information signals are then amplified by an inverting amplifier prior to being combined into a different number of information signals which are then used by the receiving device. The system accommodates the transmission of synchronized digital information without requiring the transmission of any synchronizing information signal and without requiring the resynchronization of the information signals at the second device.

27 Claims, 7 Drawing Figures

DISPLAY CONTROLLER AND DISPLAY MONITOR LOGIC

SHEET 1 OF 2

DISPLAY CONTROLLER AND DISPLAY MONITOR LOGIC

SHEET 2 OF 2

SKEW EFFECT (INTENSITY LAGGING VIDEO)

SKEW EFFECT (INTENSITY LEADING VIDEO)

TRANSMIT LOGIC AND RECEIVE LOGIC

REMOTE MONITOR INTERFACE

BACKGROUND OF THE INVENTION

1. Field of the Invention

This invention relates to the display of information of a cathode ray tube (CRT) monitor display. In particular the invention pertains to apparatus which permits this display controller which generates the dot pattern comprising the characters of information to be displayed on the CRT screen to be remotely located from the display monitor containing the monitor electronics and CRT.

2. Description of the Prior Art

Information is normally displayed on the cathode ray tube of a display monitor by selectively energizing an electron beam as it scans the sensitized screen of the CRT. The electron beam normally scans the screen from left to right in a succession of horizontal scan paths which begin at the top of the screen and end at the bottom of the screen. The beam is subsequently returned to the top of the screen for the next successive raster scan of the entire screen. This is accomplished by monitor electronics, or beam drive circuitry, associated with the cathode ray tube which magnetically deflects the beam in both the horizontal and vertical directions and selectively energizes the beam as it scans the screen of the CRT. The horizontal retrace of the beam is initiated by a horizontal synchronization (sync) signal, the vertical return of the beam to the top of the screen in initiated by a vertical sync signal and the beam is selectively energized in response to a video signal. These signals, the horizontal sync, vertical sync and video, are generated by the display controller and transferred to the monitor electronics which in turn uses them to generate the signals which drive the CRT electron beam gun and beam deflection magnets. Because of the high voltage of the beam signals involved, it is current practice to package both the monitor electronics and the cathode ray tube in close proximity and to refer to the combination of monitor electronics and CRT as the display monitor.

The display controller generates the horizontal sync, vertical sync and video signals by scanning a refresh memory in the display controller that contains the information which is to be displayed on the CRT screen. The video signal is generated by the display controller scanning the refresh memory a character at a time as each line of information is displayed on the CRT screen. The information within the display controller refresh memory may have originated from a keyboard attached to the display terminal, from a computer attached to the display controller, or remotely over a communication line attached to the display controller.

In many present applications of CRT monitor displays, it is desirable to be able to remotely locate the CRT monitor display from the display controller. Examples in which the CRT's monitor displays are remotely located include flight information at airports in which the CRT may be located several thousand feet away from the display controller to examples of computer consoles in which the CRT display may be located 3 or 4 feet from the display controller. One current method of remotely locating CRT monitor displays is to transmit a composite signal over a coaxial cable from the display controller to the monitor electronics. This is accomplished by having a modulating, or mixing, circuit at the display controller modulate the horizontal sync, vertical sync, and video signals to be different DC voltage levels on the coaxial cable. At the monitor electronics end, a demodulating, or stripping, circuit demodulates the composite signal and separates it into the horizontal sync, vertical sync and video signals which are in turn used as inputs to the monitor electronics. Although this system works well and can be economically employed for even those cases in which the monitor is located within 3 to 4 feet of the display controller, which is beyond the 1 to 2 foot range in which TTL level signals can be driven without encountering problems, the modulation and demodulation circuits required for the composite signal become more complex when used for other than single intensity monochrome monitor displays.

In single intensity monochrome monitor displays, the horizontal sync, vertical sync and video signals can be mutually exclusive and the modulating circuit need only integrate 3 separate voltage levels on the coaxial cable and the demodulating circuits need only detect 3 voltage levels in the composite signal to strip out the horizontal sync, vertical sync and video signals. These signals are mutually exclusive if: the horizontal retrace is initiated by the horizontal sync signals transitioning from the low to high state; the vertical retrace from the bottom of the screen to the top of the screen is initiated by the vertical sync signals transitioning from the low to high state; and the electron beam is energized when the video signal is in the high state; and only one of these signals is in the high state at any one time. That is, that during the horizontal retrace there is no video signal in the high state, nor is there a vertical retrace initiated, during the vertical retrace there is no horizontal retrace initiated nor video signal in the high state, and during the scan of a line in which the video signal alternates between high and low, depending upon whether the electron beam is to be energized or not, there is no horizontal retrace nor vertical retrace initiated. Therefore it can be appreciated that only three distinct DC voltage levels need be modulated onto the coaxial cable to compose the composite signal and at the other end the three distinct voltage levels may be simply demodulated to strip out each of the three signals.

Unfortunately, the modulating, and demodulating circuits used with the composite signal become more complex when multiple intensity or multichrome CRT monitor displays are employed. For example, if the CRT monitor display is used to display information in both a high and low intensity, an intensity signal must be added to the composite signal. The intensity signal is in the high state to indicate that the character of information should be displayed in the brighter dots on the screen and the intensity signal is in the low state to indicate that the character should be displayed in the lower intensity (brightness) dots on the CRT screen. In this case, the signals which compose the composite signal are no longer mutually exclusive in that the intensity signal will be in the high state whenever the video signal is in the high state to generate a dot of a character which is to be displayed at the high intensity. This non-exclusitivity between the video and intensity signals requires that the signal modulating and demodulating circuits become more complex in order that the synchronization between the intensity and video signals is maintained within acceptable limits so that the level of the intensity signal is established in synchronization with the beginning and end of video signals for each character to be displayed on the CRT screen in high intensity.

The instant invention is directed to achieving an improved apparatus which will permit the display monitor to be remotely located from the display controller and will satisfy all electrical and synchronization requirements of the application and which will result in substantial reduction in manufacturing cost.

OBJECTS OF THE INVENTION

Accordingly, it is an object of the present invention to provide a low-cost system for transferring digital information from a first device to a second device.

It is another object of the present invention to provide a digital information communication technique which is highly reliable and not susceptible to noise and other disturbances.

It is accordingly a more specific object of the present invention to provide a remote monitor interface apparatus having a low manufacturing cost.

A further object is to provide a remote monitor interface apparatus which will maintain the signals output by the display controller in synchronization such that they need not be resynchronized to correct for skew induced in their transmission from the display controller to the remote display monitor.

A still further object is to provide a remote monitor interface apparatus for use with multiple intensity or multichrome monitor displays.

This invention is pointed out with particularity in the appended claims. An understanding of the above and further objects and advantages of this invention may be obtained by referring to the following description taken in conjunction with the drawings.

SUMMARY OF THE INVENTION

The above and other objects are provided according to the basic concept of the invention through a method and apparatus for interconnecting a first device to a second device by a plurality of N parallel information channels. The first device includes a transmit section which synchronizes a plurality of N time-related digital information with the information in each signal encoded into a binary ONE or a binary ZERO, and applies the synchronized digital information signals to separate channels of the plurality of N parallel information channels. The second device includes a receive section with separate receivers for each of the plurality of N parallel information channels. The receive section thereafter amplifies the received digital information signals and combines one or more of the binary encoded signals to form at least one modulated output signal. This modulated output signal along with other of the binary encoded digital information signals are then used by the second device.

In more particular terms, the transmit section includes synchronizing logic means for synchronizing the different time-related binary encoded signals by use of a common clocking signal. These synchronized binary encoded digital information signals are then transmitted via use of balanced voltage driver chains over N twisted pairs of conductors to the receive section. The receive section receives the binary encoded digital information signals by use of balance voltage receiver chains connected to N twisted pairs of conductors and produces received information signals. These received information signals are then individually amplified by one or more parallel amplifiers to produce N amplified information signals. Some of these N amplified information signals are combined by use of a resistor network to form at least one modulated information signal. This at least one modulated signal along with others of the N amplified information signals is then used by the second device.

A feature of the invention is that it minimizes the complexity of the transmit and receive sections. Each of the signal paths in the transmit and receive sections have a common number of components connected in series thereby reducing the signal skew introduced between the different time-related information signals. Further, each of the synchronizing, transmitting, receiving, and amplifying devices in the series of devices is contained in a single integrated circuit containing the remainder of the N parallel devices of like function such that all synchronizing devices, all transmitting devices, all receiving devices, and all amplifying devices are substantially identical and operating under substantially identical operating conditions.

The above and other objects of the present invention are achieved in an illustrative embodiment described hereinafter. The novel features which are believed to be characteristic of the invention, both as to its organization and method of operation, together with further objects and advantages thereof will be better understood from the following description considered in connection with the accompanying drawings. It is to be expressly understood, however, that these drawings are for the purpose of illustration and a description only and are not intended to define the limits of this invention.

BRIEF DESCRIPTION OF THE DRAWINGS

The manner in which the apparatus of the present invention is constructed and its mode of operation can best be understood in light of the following detailed description taken together with the accompanying drawings in which like reference numerals identify like elements in the several figures and in which.

DETAILED DESCRIPTION OF THE PREFERRED EMBODIMENT

Figure 1:
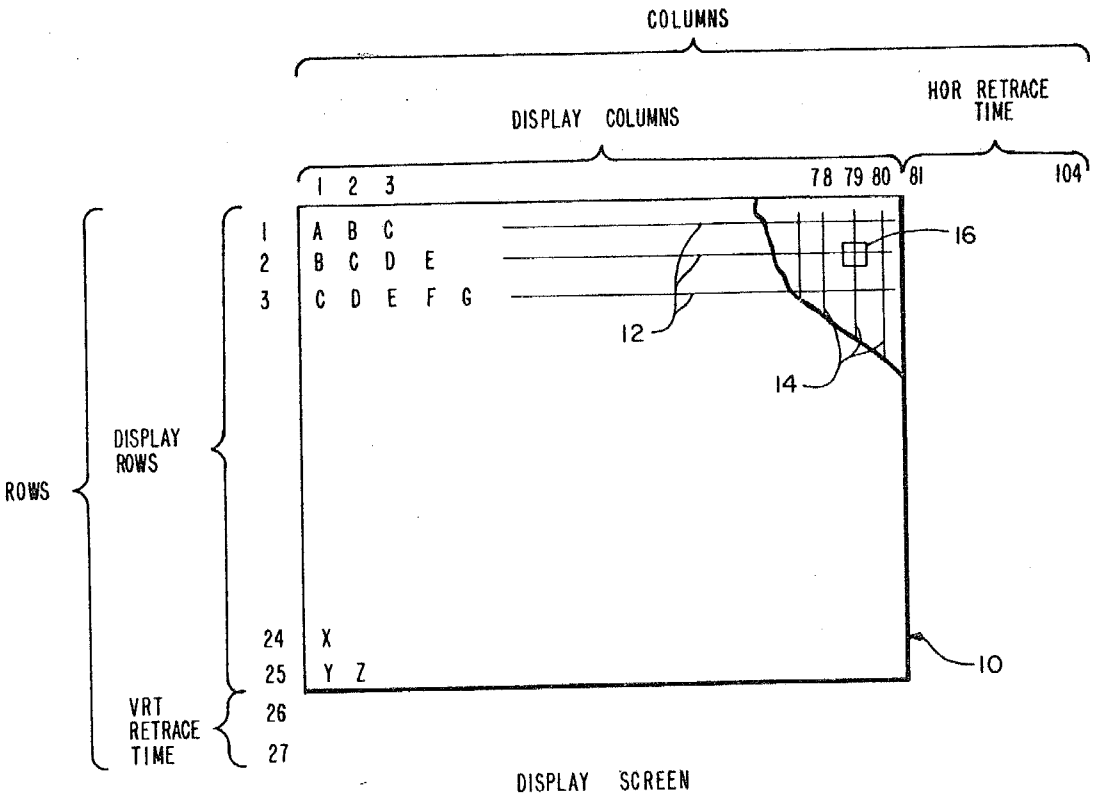
FIG. 1 is a video display of information on the display screen of a CRT.

Referring to FIG. 1, a display screen 10 is illustrated along with a particular arrangement of alphanumeric characters appearing thereon. Such a display is commonly found in computer terminals where the information is displayed on the screen for any number of purposes. It is to be noted that the alphanumeric characters appearing in FIG. 1 are arranged in a plurality of rows 12 and columns 14. In the preferred embodiment, a maximum of 80 characters are sequentially formed in columns 1 through 80 in a given row and appear on the display screen. Columns 81 through 104 as illustrated in FIG. 1 do not actually appear on the face of the display screen 10 and the time associated with them is used for the horizontal retrace of the raster scan beam between lines as described hereinafter in conjunction with FIG. 3. Also in the preferred embodiment, as illustrated in FIG. 1, there are 25 rows, rows 1 through 25, appearing on display screen 10. Rows 26 and 27 as illustrated in FIG. 1 do not appear on display screen 10 and the time associated therewith is used for the vertical retrace of the raster scan beam as will be discussed hereinafter in conjunction with FIG. 3.

Figure 2:
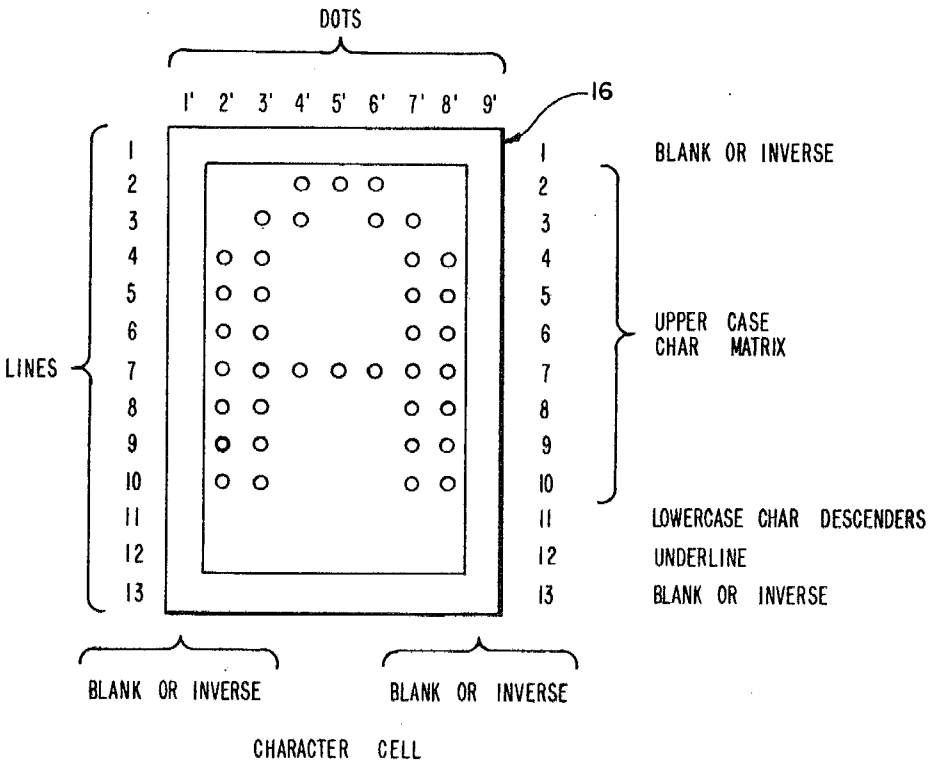
FIG. 2 illustrates the formation of a character within a character cell on the display screen of FIG. 1.

Referring now to FIG. 2, the alphanumeric character occupying the character cell 16 formed by the intersection of row 2 with column 79 on display screen 10 of FIG. 1 has been illustrated in detail. The particular alphanumeric character which is illustrated is that of the letter "A". The character cell is formed by a 9 by 13 dot matrix field. Each dot in the matrix, although illustrated in FIG. 2 as a circular spot, is actually a rectangular spot with no break between consequentive illuminated spots in the same line. Characters are formed in a character cell 16 along with other characters on the same row by sequentially illuminating appropriate dots on a number of horizontal scan lines. These horizontal scan lines are numbered 1 through 13 in FIG. 2. Dots are illuminated within these lines at dot locations denoted as 1′ through 9′. In the preferred embodiment, uppercase characters are displayed in a 7 by 9 field formed by dots 2′ through 8′ of rows 2 through 10. Dots 2′ through 8′ of row 11 are used for lowercase character descenders. Line 12, dots 1′ through 9′ are used to underline a character. The other border of dots formed dots by 1′ and 9′ of lines 1 through 13 and dots 2′ through 8′ of lines 1 and 13 are blank when the normal image on the screen is a dark background with a character displayed with bright or lighted dots. In the normal image mode, when bright characters are displayed against a dark background, dot locations 2′ through 8′ are selectively illuminated so as to define a given line of each character as it is formed within a given row. When characters are displayed on the screen in the inverse video mode, the background of the character is light and the character is displayed as a series of dark dots in which case the outer border of dots of the character cell is a series of bright or lighted dots. In the inverse video mode, dot locations 1′ through 9′ are selectively illuminated so as to define a given line of the background of a character as it is formed within a given row.

Figure 3:
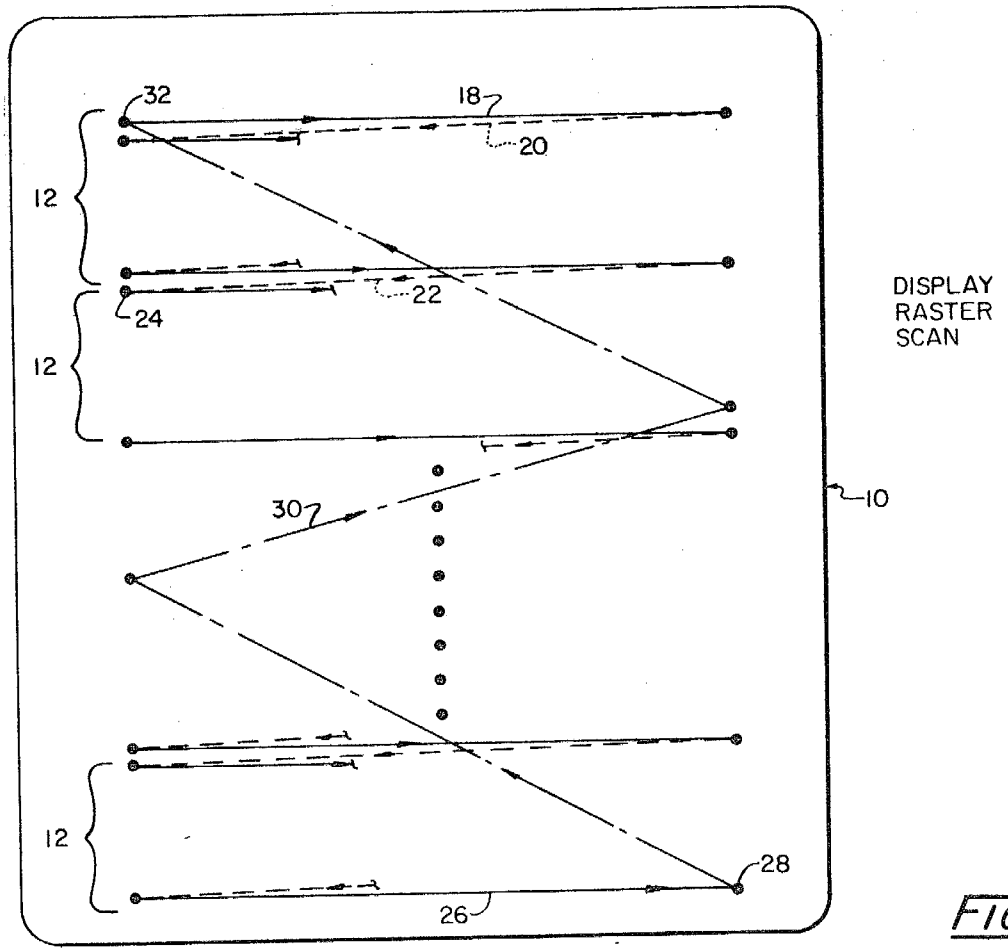
FIG. 3 illustrates the raster scan necessary to accomplish the video display of FIG. 1.

Referring now to FIG. 3, a typical raster scan is illustrated for the entire display screen 10. It is to be understood that such a raster scan would be necessary in order to form the displayed arrangement of characters in FIG. 1. In this regard, the raster scan comprises a number of individual rows such as rows 12. Each individual row comprises 13 individual horizontal scan lines such as 18. Each individual scan line is accompanied with a horizontal retrace path such as 20 which brings the electron beam back to a position for the next horizontal scan from left to right. This retrace between scan lines occurs during column times 81 through 104 as shown in FIG. 1. The next successive row of characters begins once a horizontal retrace path has been completed for the thirteenth scan line of the previous row of characters. In this regard, a retrace path 22 brings the electron beam back to a point 24 for the subsequent scan line of the next successive row. This process continues to occur until twenty-five separate rows have been formed on the display screen 10. At this time, the electron beam will have traversed a final horizontal scan line 26 in the bottommost row. When the electron beam reaches a point 28 at the end of the scan line 26, it is caused to retrace a dotted outline path 30 back to a point 32 wherein the next succession of horizontal scans begin. The dotted outline path 30 will hereinafter be referred to as the vertical retrace. During this vertical retrace which occurs during row times 26 and 27 as shown in FIG. 1, the scan path forms a zig-zag course as it travels from left to right and from right to left twenty-six times for the scan lines and horizontal retrace paths associated with row times 26 and 27 as shown in FIG. 1. Because the electron beam is not energized by a video signal during either a horizontal retrace or vertical retrace, the individual horizontal retrace paths, such as 20 and 22, and the zig-zag vertical retrace path 30 are not visible on display screen 10.

It is to be appreciated that successive raster scans must occur at a sufficient rate to refresh the displayed information on the display screen 10 of FIG. 1. In the preferred embodiment, information on display screen 10 is refreshed approximately 60 times per second with the beginning of the next scan being triggered by the completion of the previous scan and with all timing being derived from a 19.712 megahertz oscillator as discussed hereinafter with respect to FIG. 4.

Figure 4:
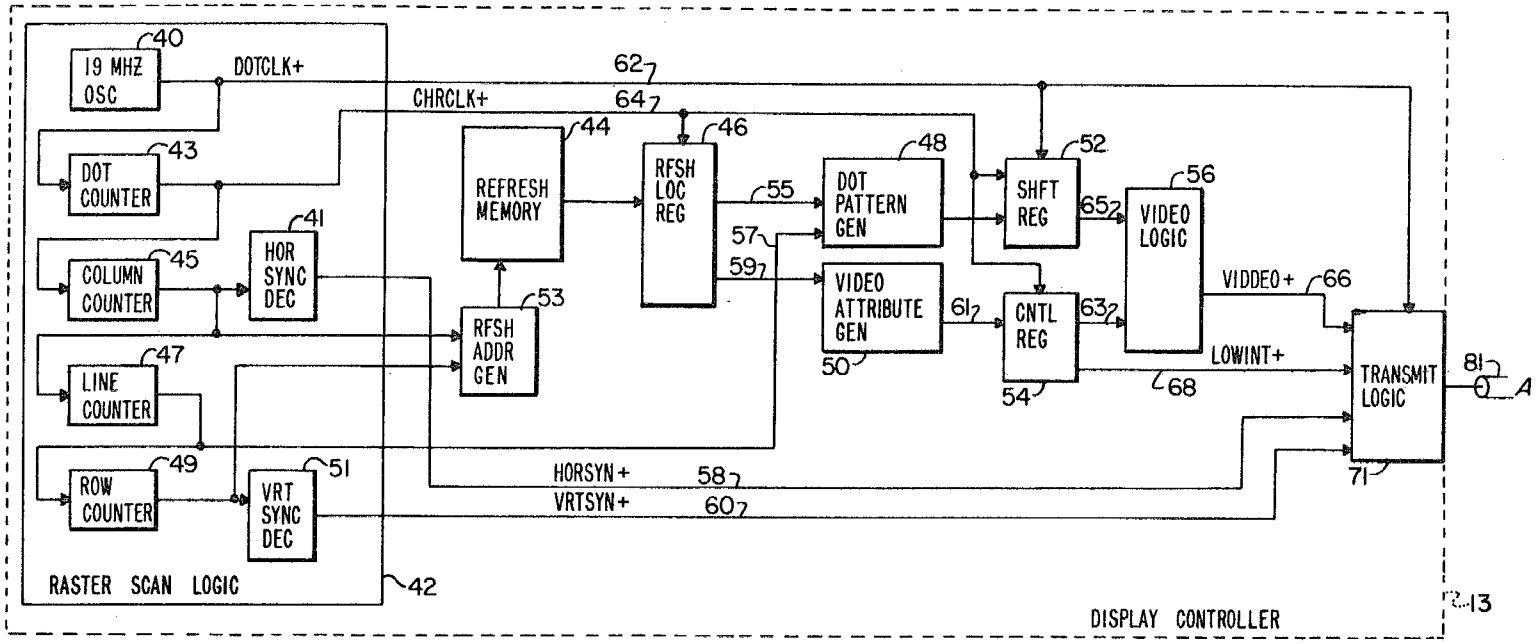
FIG. 4 is a block diagram of the display controller and display monitor logic used to form the video display of FIG. 1.
Figure 4:
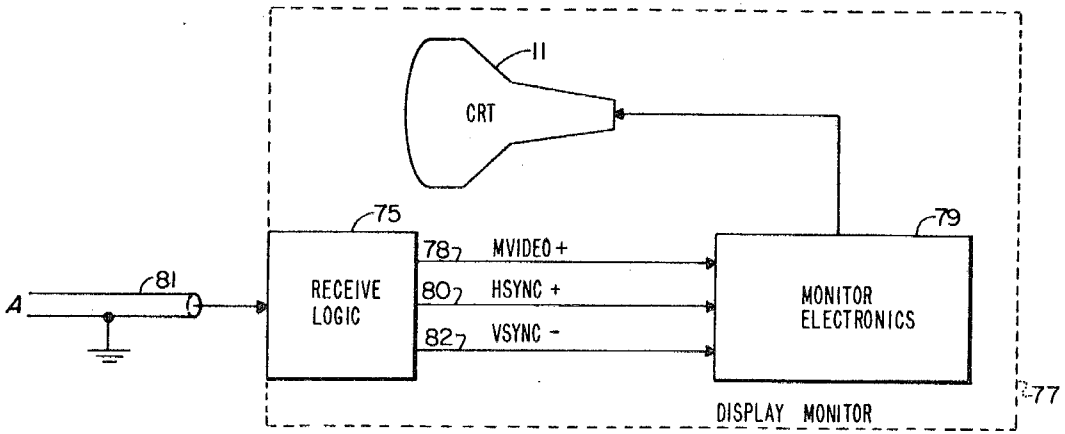

Referring now to FIG. 4, display controller 13 is operatively coupled to display monitor 77 via cable 81 such that the information contained in refresh memory 44 will be displayed on the screen of CRT 11. The exact manner in which this is accomplished will be apparent hereinafter.

The raster scan logic 42 controls the display of information through a dot clocking signal (DOTCLK+) via line 62, a character clocking signal (CHRCLK+) via line 64, a horizontal synchronization signal (HORSYN+) via line 58 and a vertical synchronization signal (VRTSYN+) via line 60. The information to be displayed on the screen of CRT 11 is retrieved from refresh memory 44 a character at a time and by the various logic of display controller 13 results in video logic 56 generating a video signal (VIDDEO+) on line 66. Along with each character of information to be displayed on the screen of the CRT 11, refresh memory 44 contains attribute information which affects how the character information is displayed on the screen of CRT 11.

In the preferred embodiment, each character of information may have the following attributes associated with the character: hide, blink, inverse video, underline and low intensity. If the hide attribute is selected, the character of information will not be displayed on the screen of CRT 11 although the character of information will remain unaffected in the refresh memory 44. If the blink attribute is selected, the character of information will be displayed on the screen of CRT 11 by flashing on and off as the image on the screen is refreshed. If the inverse video attribute is selected, the character will be displayed in the inverse video mode in which a dark character will be displayed against a light background. If the low intensity attribute is selected, the character of information will be displayed on the screen of CRT 11 in a low intensity level which is below that of the normal brightness of the character dots. If the underline attribute is selected, the character will be displayed on the screen with an underlying row of dots appearing in line 12 of the character cell 16 (see FIG. 2).

The hide, blink, inverse video and underline attributes affect the dot pattern display on the screen via video logic 56 and are reflected in video signal VIDDEO+. The low intensity attribute directly affects a low intensity signal (LOWINT+) on line 68. Video signal VIDDEO+ will be in its high state, or logical ONE state, when a dot on the screen of CRT 11 is to be generated by energizing the electron beam within display monitor 77. Low intensity signal LOWINT+ will be in the logical ONE state whenever the dots being displayed on the screen of CRT 11 are to be displayed in the low intensity (reduced brightness) mode.

The aforementioned illumination of dots occur while the electron beam is driven in a horizontal direction across the display screen 10. This is accomplished within the display monitor 77 by the beam drive circuitry of monitor electronics 79. This circuitry is responsive to the horizontal synchronization signal HSYNC+ on line 80 from receive logic 75 which is derived from the horizontal synchronization signal HORSYN+ on line 58 from raster scan logic 42 which is transmitted by transmit logic 71 on cable 81. The horizontal synchronization signal HSYNC+ appears on line 80 and is operative to initiate horizontal retrace of the electron beam as well as the subsequent horizontal scan of the individual lines by the electron beam. It is noted that the display controller 13 is operative to disable the generation of a high level video signal VIDDEO+ during such horizontal retraces such that the retrace pass is not visible on display screen 10.

The raster scan logic is also operative to initiate a vertical retrace of the electron beam within display monitor 77. A vertical retrace is initiated by vertical synchronization signal VRTSYN+ on line 60 from raster scan logic 42 going to a high state. The signal is transmitted by transmit logic 71 via cable 81 to receive logic 75 which in turn results in the video synchronization signal VSYNC− on line 82 going to a low level which in turn causes the vertical beam drive circuitry within monitor electronics 79 to move the electron beam back to the top of display screen 10. Logic within display controller 13 also inhibits the generation of a high level video signal VIDDEO+ during this vertical retrace thereby inhibiting the zig-zag vertical retrace pattern being visible on display screen 10.

It is to be understood that certain of the heretoforementioned elements within FIG. 4 are well known in the art and will therefore not be disclosed in detail herein. In particular it is to be noted that CRT 11 and monitor electronics 79 may be obtained commercially from Ball Brothers Research Corporation, Electronic Display Division, St. Paul, Minn. 55166.

The display controller 13 of FIG. 4 will now be discussed in further detail. Raster scan logic 42 provides a display controller 13 with dot times, character times, line times, and row times. The raster scan logic 42 begins with a continuous 19.712 megahertz oscillator 40 which drives dot counter 43. Oscillator 40 provides a dot clocking signal (DOTCLK+) on line 62 and also provides the input to dot counter 43. This dot time is input to dot counter 43 which divides the dot count by 9, which is the width of the character cell in dots per horizontal scan line, by generating a cyclical dot count of 0 through 8 to produce a character clocking signal (CHRCLK+) on line 64. This character time is input to column counter 45 which divides the column count by 104, which is the number of columns in a horizontal scan line (see FIG. 1), by generating a cyclical count of 0 through 103. The column count output by column counter 45 is input to horizontal synchronization decoder 41 which decodes column counts 80 through 103 and generates a horizontal synchronization signal (HORSYN+) on line 58. Signal HORSYN+ is in the low state during column counts 0 through 79 (corresponding to columns 1 through 80 of FIG. 1) when information is to be displayed on display screen 10 and in the high state during column counts 80 through 103 (corresponding to columns 81 through 104 of FIG. 1) when the horizontal retrace is to occur. The output of column counter 45 is also input to line counter 47 which divides the line count by 13, which is the number of lines per row (character cell, see FIG. 2) by generating a cyclical count of 0 through 12. The output of line counter 47 is input to row counter 49 which divides the row count by 27, which is the number of rows in a vertical scan of the display screen (see FIG. 1), by generating a cyclical count of 0 through 26. The row count output by row counter 49 is input to vertical synchronization decoder 51 which decodes row counts 25 and 26, and generates a vertical synchronization signal (VRTSYN+) on line 60. Signal VRTSYN+ is in the low state during row counts 0 through 24 (corresponding to rows 1 through 25 of FIG. 1) when information is displayed on display screen 10 and in the high state during row count 25 and 26 (corresponding to rows 26 and 27 of FIG. 1) when the vertical retrace is to occur.

Thus as described hereinbefore, the first 80 column counts represent characters actually displayed on the display screen 10 and the next 24 counts are used for the horizontal retrace and do not cause characters to be displayed. The first 25 rows of characters represent rows which are displayed on a display screen 10 and the last 2 rows are used during the vertical retrace time.

The column count output by column counter 45 and the row count output by row counter 49 are input to refresh address generator 53 which generates an address in refresh memory 44 which identifies which memory location within the refresh memory containing the character information and attribute information associated with the character which is to be displayed for a particular character cell. The 16-bit words are read from refresh memory 44 and clocked into refresh local register 46 by character clocking signal CHRCLK+. Seven bits of each 16-bit word are used to contain the ASCII code for the character which is to be displayed on the screen and are fed to dot pattern generator 48 on line 55 to get the dot pattern of a line within the dot matrix associated with the information character to be displayed. The output of line counter 47 on line 57 is also input to dot pattern generator 48 so that the dot pattern associated with each particular line of the character cell can be generated as the horizontal scan progresses from scan line to scan line. The output of pattern generator 48 is loaded into shift register 52 by character clocking signal CHRCLK+ on line 64. After the dot pattern associated with the current line of the character cell is loaded into shift register 52, it is shifted one dot at a time by dot clocking signal DOTCLK+ on line 62 so that the output signal on line 65 follows the horizontal scan of the electron beam as it progresses across the dots of the character cell. Other bits from the 16-bit word from refresh memory 44 indicates the video attributes associated with the character and are fed from refresh local register 46 on line 59 into video attribute generator 50. Video attribute generator 50 provides output signals which indicate: normal video, inverse video, and intensity level. These video attribute signals on line 61 are clocked into control register 54 by character clocking signal CHRCLK+ because these signals remain constant for each of the 9 dots associated with the horizontal scan line of a particular character cell. The normal and inverse video control signals on line 63 are combined along with the output of shift register 52 on line 65 by video logic 56 to provide a video signal (VIDDEO+) on line 66. This video signal VIDDEO+ is clocked into transmit logic 71 by dot clocking signal DOTCLK+ along with the low intensity signal from control register 54, and the horizontal synchronization signal HORSYN+ and the vertical synchronization signal VRTSYN+ from raster scan logic 42. These four TTL level signals are converted into signal levels suitable for transmission over cable 81 to receive logic 75 which converts the signals back to TTL level signals and generates a modulated video signal MVIDEO+, and horizontal synchronization signal HSYNC+ and vertical synchronization signal VSYNC−. This conversion from TTL level signals before transmission over cable 81 and reconversion to TTL level signals after transmission over cable 81 is necessary because of the fact that cable 81 exceeds the relatively short distance of 1 or 2 feet over which TTL level signals can be reliably transmitted.

Before describing transmit logic 71 and receive logic 77 in detail, a critical design objective will be discussed. In the transmission of multiple signals between two points, it is particularly important that the synchronization between the signals be maintained. In the preferred embodiment, in which four signals are transmitted from display controller 13 to the display monitor 77, it is important that the synchronization between the video, intensity, horizontal synchronization and vertical synchronization signals be maintained. This is particularly the case for high resolution display monitors of the type employed in the preferred embodiment of the instant invention if the characters of information displayed on the screen are to be stable, clear and clean and not fuzzy. In the preferred embodiment, the time it takes for the horizontal scan of the electron beam to scan the length of one dot of the character matrix is approximately 50.7 nanoseconds, this time representing the outer limits by which the signal may be out of synchronization without seriously affecting the clarity of the image on the display screen. As discussed hereinafter, empirical tests have shown that the maximum permissible missynchronization, or skew, of the signals is in fact 16 nanoseconds from dot scan times of 50.7 nanoseconds.

Figure 5A:
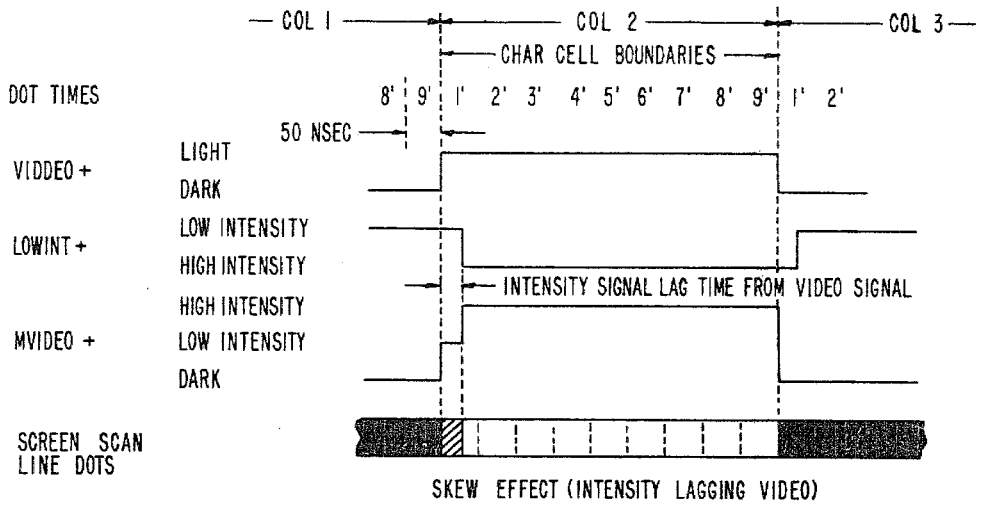
FIGS. 5A and 5B are diagrams illustrating the effect of skew between the video signal and intensity signal on a horizontal scan line of the character cell of FIG. 2.
Figure 5B:
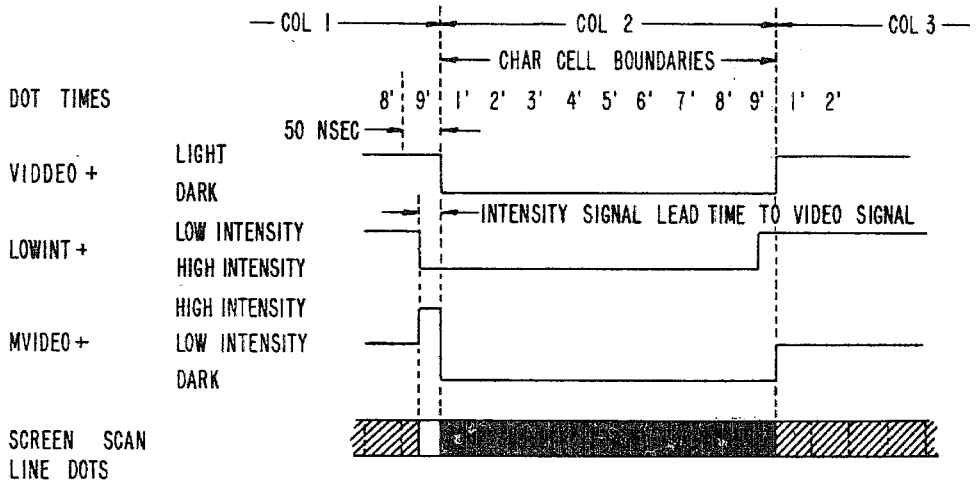

Within the preferred embodiment, the maintenance of synchronization between the video signal and the intensity signal is the most critical. Now referring to FIGS. 5A and 5B, two cases of signal skew will be discussed. FIG. 5A illustrates the case in which the intensity signal lags the video signal and FIG. 5B illustrates the case in which the intensity signal leads the video signal.

Referring now to FIG. 5A, the case in which the intensity signal lags the video signal will be discussed. In this case, the video signal arrives first and turns the video on to the low intensity state associated with the previous character cell, and sometime later the high intensity signal for the current character cell arrives. This results in the first dot of the current character cell being displayed in two intensities (low then high). FIG. 5A illustrates the dot times associated with: a trailing edge of a character cell in column 1 of display screen 10 (see FIG. 1), a full character cell in column 2, and a leading edge of a character cell in column 3. Video signal VIDDEO+ found on line 66 of FIG. 4 is illustrated such that when the signal is in the low state, logical ZERO, the electron beam of CRT 11 will not illuminate a dot on the display screen 10 and when in the high state, logical ONE, will illuminate a dot on display screen 10. Intensity signal LOWINT+ is illustrated such that when the signal is in the high state, logical ONE, any dot being displayed on the screen is to be displayed in low intensity (medium brightness) and when in the low state, logical ZERO, any dot being displayed on the screen is to be displayed in the high intensity (full brightness). Modulated video signal MVIDEO+ is a signal found on line 78. Signal MVIDEO+ is a composite of the video and intensity signals and is generated by receive logic 75 as will be discussed hereinafter with respect to FIG. 6.

Although the monitor electronics 79 used in the preferred embodiment is designed to have a video input signal in either a high state or a low state, thereby producing an image on the display screen 10 of CRT 11 in either a dark (no illumination) or light (full brightness) dots, it has been found that by biasing the video input signal into an intermediate voltage level between the voltage level used to indicate a dark dot on the screen and the voltage level used to indicate a full brightness dot on the screen that a dot of intermediate intensity can be generated. Thus a low voltage level video signal produces no dot on the screen (i.e., a dark dot), an intermediary voltage level produces a low intensity (medium brightness) dot and a high voltage level produces a high intensity (full brightness) dot on the display screen. Thus in the preferred embodiment, modulated video signal MVIDEO+ when in the high voltage range of 3.0 to 4.0 volts DC will produce a high intensity (full brightness) dot on the screen, when in the low voltage range of 0.0 to 0.4 volts DC will produce a no dot (dark dot) on the screen, and when at an intermediate voltage level between 0.4 and 4.0 volts DC will produce a low intensity (medium brightness) dot on the screen. The exact voltage level used as input to the monitor electronics 79 for the low intensity video signal is determined by adjusting a variable resistor as discussed hereinafter with respect to FIG. 6.

The screen scan line dots illustrated in FIG. 5A represent the horizontal scan line of dots formed on the display screen 10 of CRT 11 as a result of monitor electronics 79 receiving the illustrated modulated video signal MVIDEO+. In the scan line of dots, those portions of the scan line illustrated in black will be displayed as dark spots on the display screen, those portions illustrated by hash marks will be displayed in low intensity on the display screen and those portions illustrated in white will be displayed in high intensity on display screen 10.

As illustrated in FIG. 5A, the video signal VIDDEO+ corresponds to the case in which dots 1' through 9' in column 2 are to be light and dots 8' and 9' of column 1 and dots 1' through 2' of column 3 are to be dark. Referring now to FIG. 2, it can be appreciated that this video signal corresponds to the case in which the underline line, line 12 of the character cell, is being scanned and the character in column 1 is not underlined, the character in column 2 is underlined, and the character in column 3 is not underlined. This case is chosen because the critical problems between the synchronization of the intensity and video signals occur at the character cell boundaries and the underlining of a character is a case in which dots in 1′ and 9′ are illuminated. In the preferred embodiment, the most critical case occurs in the dots along the character cell boundaries because the intensity signal only changes at the character cell boundaries since the all dots within a character cell are displayed at the same intensity level. That is, within a given character cell the matrix is composed of either high intensity dots and dark dots or of low intensity dots and dark dots.

Referring to the low intensity signal in FIG. 5A, signal LOWINT+, it can be appreciated that the character in column 1 is to be displayed in low intensity, the character in column 2 is to be displayed in high intensity, and the character in column 3 is to be displayed in low intensity. Although in the preferred embodiment the low intensity signal will either be in the high state or low state for the full width of a character cell, the video signal may in fact change between the light state and the dark state on an individual dot basis and is illustrated as being in the dark state for column 1 and column 3 and in the light state for column 2 because that is the shape of the video signal associated with the line 12 of the character cell for an underlined character which is surrounded by 2 characters which are not underlined.

FIG. 5A illustrates the case in which the intensity signal is skewed with respect to the video signal such that the intensity signal does not change state at the character cell boundaries but instead lags behind the video signal for approximately half the scan time of dot 1′. As will be seen hereinafter in the discussion of receive logic 75 in FIG. 6, the modulation of the video signal by the intensity signal will result in the modulated video signal MVIDEO+ shown in FIG. 5 in which the signal goes from the dark state to the low intensity state for the first half of dot 1′ of column 2 and then goes to the high intensity state for the remainder of dot 1′ and through dot 9′ of column 2. It should be further noted that the modulated video signal MVIDEO+ changes from the high intensity state to the dark state at the character cell boundary between column 2 and column 3 in response to the video signal going from the light to the dark state. Thus it can be appreciated that the presence of the video signal in the light state will cause the modulated video signal MVIDEO+ to be either in the low intensity or the high intensity state. It is the intensity signal LOWINT+ which controls which of the two intensities the modulated video signal is in. Referring now to the scan line dots which will appear on display screen 10, it can be appreciated that the dots associated with column 1 will be dark (black in FIG. 5A) as will those associated with column 3. The dots associated with column 2, all of which will be displayed as high intensity (full brightness) dots if the video and intensity signals were in proper synchronization, will actually be displayed with the first half of the 1′ dot being displayed in low intensity (hash mark in FIG. 5A) and the remainder of the dots 1′ through 9′ being displayed in high intensity (white in FIG. 5A).

Turning now to FIG. 5B, a case similar to that illustrated in FIG. 5A will be discussed. However in this case, the intensity signal arrives first and changes the video which is already on from the low intensity state associated with the current character cell to the high intensity state associated with the next character cell, and sometime later the video signal arrives for the next character cell and turns off the video. Also the video signal in FIG. 5B is the inverse of the video signal in FIG. 5A. Thus if the video signal in FIG. 5B is again to be associated with line 12 of a character cell, the underline line, the video signal VIDDEO+ in FIG. 5B, illustrates the case in which column 1, column 2 and column 3 are displayed in the inverse video mode (i.e., dark characters are displayed against a light background) with the character in column 2 being underlined and surrounded by characters in column 1 and 3 which are not underlined. The intensity signal LOWINT+ in FIG. 5B again illustrates the case (as is in FIG. 5A) in which the characters in columns 1 and 3 are to be displayed in low intensity and the character in column 2 is to be displayed in high intensity.

As in FIG. 5A, the modulated video signal in FIG. 5B, signal MVIDEO+, is generated by receive logic 75 by combining the video (VIDEO+) and the intensity (LOWINT+) signals. The resultant modulated video signal shows that the dots associated with column 1 will be displayed in low intensity with the exception of the last half of dot 9′ which will be displayed in high intensity because the low intensity signal went to the high intensity state before the video signal went to the dark state. FIG. 5B also shows that all of the dots associated with column 2 will be displayed in the dark state and the beginning dots associated with column 3 will be displayed in the low intensity. Dot 1′ of column 3 is not affected by the missynchronization of the intensity signal with the video signal because the proper intensity signal level is established before the video signal changed from dark to light.

By referring to the screen scan line dots of FIG. 5A and FIG. 5B, it can be appreciated that if the intensity signal is skewed with respect to the video signal such that it lags the video signal the beginning dots of a character cell may be affected. If the intensity signal leads the video signal, the trailing dots of a character cell will be affected. In the preferred embodiment, in which the time to horizontally scan the length of one dot of a character cell is approximately 50.7 nanoseconds, it has been found, by empirical tests in which the skew between the intensity signal and the video signal could be controlled, that if the video signal and the intensity signal are not within 16 nanoseconds of synchronization that the resultant fuzziness caused by having a dot illuminated with a portion in high intensity and a portion in low intensity becomes visually objectionable to an observer. It should be noted that the degree of distortion (fuzziness) acceptable to the display screen observer is a subjective measurement.

Figure 6:
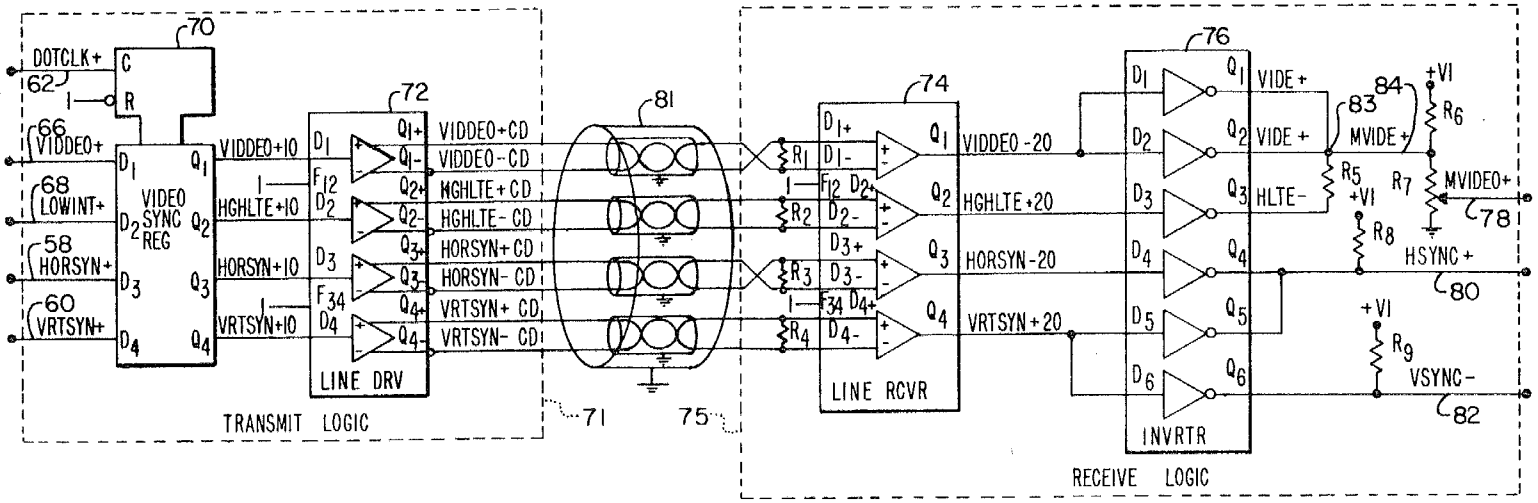
FIG. 6 is a detailed illustration of the transmit logic and receive logic of FIG. 4.

Referring now to FIG. 6, the transmit logic 71 and receive logic 75 will now be discussed in detail. Video synchronization register 70 and line driver 72 comprise transmit logic 71. A set of resistors which terminate cable 81, resistors R1 through R4, line receiver 74, inverter 76, and a second series of resistors R5 through R9 comprise receive logic 75. Transmit logic 71 takes the four information signals: video, intensity, horizontal sync, and vertical sync and transmits them to receive logic 75 via cable 81 in parallel. Receive logic 75 takes these four input signals from the display controller and maintains the synchronization between the signals, and via the second set of resistors R5 through R9, produces the three signals required as inputs to monitor electronics 79. Receive logic 75 takes the four input signals and produces the three output signals by combining the video and intensity signals into a modulated video signal (MVIDEO+) and basically passes the horizontal sync and vertical sync signals through unaltered. Thus, transmit logic 71, cable 81, and receive logic 75 are designed such that the synchronization between the signals is established in transmit logic 71 and maintained without resynchronization such that the output of receive logic 75 has maintained the synchronization between the signals within the 16 nanoseconds maximum skew limit as discussed hereinbefore with respect to FIG. 5A and FIG. 5B.

Video synchronization register 70 has as inputs: video signal VIDDEO+ on line 66, intensity signal LOWINT+ on line 68, horizontal synchronization signal HORSYN+ on line 58, and vertical synchronization signal VRTSYN+ on line 60. These four signals are clocked into the video synchronization register 70 by the dot clocking signal DOTCLK+ on line 62 transitioning from the logical ZERO to logical ONE state. In the preferred embodiment, video synchronization register 70 is a single integrated circuit comprised of multiple D-type flip-flops each of which is clocked by a common clocking (C) input signal and clearable by a common reset (R) input signal. As illustrated in FIG. 6, the reset input of video synchronization register 70 is maintained as a logical ONE such that the transition of the clocking signal from a logical ZERO to a logical ONE state will clock the inputs (D1–D4) of the D-type flip-flops to their corresponding outputs (Q1–Q4). In the preferred embodiment, video synchronization register 70 is a type SN74S174 D-type flip-flop manufactured by Texas Instruments Inc. of Dallas, Texas and is described in their publication entitled, *The TTL Data Book for Design Engineers,* Second Edition. This type SN74S174 integrated circuit actually contains six D-type flip-flops but only four are used in the synchronizing of the signals before they are presented to line driver 72.

The signals output by video synchronization register 70, video signal VIDDEO+10, low intensity signal HGHLTE+10, horizontal synchronization signal HORSYN+10, and video synchronization signal VRTSYN+10, are in turn the inputs of line driver 72. Line driver 72 is a single integrated circuit which contains four independent driver chains which comply with EIA standards for electrical characteristics of balanced voltage digital interface circuits. The outputs of line driver 72 (Q1+ through Q4−) are three-state structures which are forced to a high impedance state when the corresponding function (F) input is a logical ZERO. In the preferred embodiment, function input F12, which controls the output of drivers 1 and 2, and function input F34, which controls the output of drivers 3 and 4, are set to a logical ONE such that the output of the driver is either a logical ZERO or a logical ONE and never in the third state (high impedance). In the preferred embodiment, line driver 72 is a type MC3487 integrated circuit manufactured by Motorola Inc. of Phoenix, Arizona 85036.

Each driver of line driver 72 takes the TTL compatible input (D1 through D4) and produces two balanced voltage outputs Q1+ and Q1− through Q4+ and Q4−) which are transmitted by cable 81 to receive logic 75. If the Q+ output of each driver is in the same state as the input to the driver and the Q− output is the inverted output and it is in the opposite state of the input. The outputs of line driver 72, the four pairs of signals VIDDEO+CD and VIDDEO−CD, HGHLTE+CD and HGHLTE−CD, HORSYN+CD and HORSYN−CD, and VRTSYN+CD and VRTSYN−CD which correspond respectively to the input signals VIDDEO+10, HGHLTE+10, HORSYN+10, and VRTSYN+10 are transmitted from transmit logic 71 to receive logic 75 via cable 81. Cable 81 comprises four pairs of twisted wire leads. Each of these pairs of twisted wire leads is terminated at the receive logic 75 by a resistor (R1 through R4). In the preferred embodiment, the value of the resistors R1 through R4 is 100 ohms which matches the characteristics impedance of the twisted wire transmission line of cable 81 thereby preventing reflection of the signal in cable 81. After being terminated by terminating resistors R1 through R4, the four pairs of balance voltage signals are then input to line receiver 74.

Line receiver 74 is a single integrated circuit which contains four independent receiver chains which comply with EIA standards for electrical characteristics for balanced/unbalanced voltage digital interface circuits. The outputs of line receiver 74 (Q1 through Q4) are three-state structures which are forced to a high impedance state if the corresponding function input signal (F12 or F34) is in a logical ZERO state. In the preferred embodiment, function (F) inputs F12 and F34 are maintained in the logical ONE state and therefore Q1 and Q4 will be either in a logical ONE or logical ZERO state depending upon their corresponding inputs (D1+ and D1− through D4+ and D4−). In the preferred embodiment, line receiver 74 is a type MC3486 integrated circuit manufactured by Motorola Inc. of Phoenix, Arizona 85036.

FIG. 6 shows that the balance voltage outputs for the video signal and the horizontal synchronization signal are interchanged at the inputs of line receiver 74 such that if the video signal VIDDEO+10 is in the logical ONE state at input D1 of line driver 72 the corresponding signal VIDDEO−20 at output Q1 of line receiver 74 will be in the logical ZERO state. Similarly signal HORSYN+10 at input D3 of line driver 72 is inverted with respect to its corresponding signal HORSYN−20 at output Q3 of line receiver 74. This inversion of signals between the inputs of line driver 72 and the outputs of line receiver 74 by interchanging the balanced voltage input signals is done in order to provide signals of the required logical state at the inputs of inverter 74 and thereby eliminates any requirement for any other inverting logical element between the outputs of video synchronization register 70 and the inputs of inverter 76.

The four TTL level signals from line receiver 74 are fed into inverting amplifier 76 which provides signals at the levels required for inputs into monitor electronics 79. The primary purpose of inverting amplifier 76 is to amplify the signals from receiver 74, the inverting function could be done by reversing the polarity of the outputs of transmitter 72 with the inputs of receiver 74 as described hereinbefore with respect to signals VIDDEO+CD and VIDDEO−CD and signals HORSYN+CD and HORSYN−CD. Inverter 76 is a single integrated circuit containing six open-collector inverting amplifiers. Open-collector inverting amplifiers are used so that the low intensity signal appearing at the Q3 output of inverter 76 may be effectively subtracted from the video signal appearing at the Q1 and Q2 outputs of inverter 76 thereby providing the modulated video signal MVIDE+ on line 84. Video signal VIDDEO−20 is input to two inverters in parallel with the inverted output appearing at the Q1 and Q2 outputs of inverter 76. Two parallel inverters are used to invert the video signal so that the current flowing through each individual inverter is less than the maximum current allowable for an individual inverter. In the preferred embodiment, voltage V1 is 5 volts DC and resistor R6 is 150 ohms. The output of the inverted video signal, signal VIDE+ at the Q1 and Q2 outputs of inverter 76, is combined with the inverted low intensity signal, signal HLTE− at the Q3 output of inverter 76 at point 83. Video signal VIDE+ will be a logical ONE if a dot is to appear on display screen 10. Low intensity signal HLTE− will be a logical ZERO if the dots (all the illuminated dots in the character cell) are to be displayed on the display screen 10 in the low intensity mode and a logical ONE if the dots are to be displayed on the screen in the high intensity mode.

Combining the video signal VIDE+ with the low intensity signal HLTE− via resistor R5 at point 83 results in a modulated video signal MVIDE+ on line 84. In the preferred embodiment, resistor R5 is a 510 ohms resistor. Signal MVIDE+ on line 84 is a modulated video signal in that it is in: a high level when the video is to be displayed on the display screen 10 at full intensity, an intermediate level when the video is to be displayed on display screen 10 in an intermediate (low) intensity, and a low level when no video is to be displayed on display screen 10. This three-level modulated video signal was discussed hereinbefore with respect to FIGS. 5A and 5B. Ignoring for a moment the effect of low intensity signal HLTE−, the video signal MVIDEO+ which is supplied to the monitor electronics 79 on line 78 would normally be a high or low level signal as a function of the video signal VIDE+ at the Q1 and Q2 outputs of open-collector inverter 76 and also as a function of resistor divider network R6 and R7. In the preferred embodiment, R6 is a 150 ohms resistor and R7 is a 500 ohms variable resistor. The effect of the low intensity signal is such that, if the low intensity signal HLTE− is a logical ZERO (low voltage) at the Q3 output of open-collector inverter 76 and the video signal VIDE+ at the Q1 and Q2 outputs of inverter 76 is a logical ONE (high voltage), current will flow through resistor R5 and reduce the voltage level at point 83 and on line 84 thus producing an intermediate voltage level modulated video signal MVIDE+. If signals HLTE− and VIDE+ are both logical ONEs (high voltage levels) indicating that a dot is to be illuminated at full brightness, no current flows through resistor R5 and modulated video signal MVIDE+ will be a high voltage level signal. In the preferred embodiment, R5 is a 510 ohms resistor. Variable resistor R7 is used to adjust the contrast between the high and low intensity dots generated on the face of display screen 10. Resistor R7 is adjusted such that the voltage level of the modulated video signal MVIDEO+ for a low intensity dot is biased to the threshold of the circuit in the monitor electronics 79 which is used to drive the video of CRT 11. This biasing of the low intensity voltage level to the threshold of the electron beam drive circuitry is necessary because in the preferred embodiment the particular monitor electronics 79 are designed for a single (adjustable for linear mode) video input. By biasing the low intensity voltage level between the light and dark voltage levels, a low intensity dot can be generated.

Horizontal synchronization signal HORSYN−20 is inverted by two parallel open-collector inverters and the output thereof at outputs Q4 and Q5 of inverter 76, signal HSYNC+ on line 80, is the horizontal synchronization signal input to monitor electronics 79. Signal HSYNC+ is a logical ONE (high voltage level), as required by the monitor electronics 79, during the time in which the horizontal retrace is taking place and a logical ZERO (low voltage level) during the time that the horizontal scan line is displaying information on display screen 10. Again, as in the case of the video signal, two parallel open-collector inverters are used so that the current in each inverter does not exceed the maximum allowable current rating of the individual inverters. In the preferred embodiment, resistor R8 is a 330 ohms resistor and again voltage V1 is +5 volts DC.

Vertical synchronization signal VRTSYN+20 is inverted by inverter 76 and produces signal VSYNC− on line 82 at the Q6 output. Vertical synchronization signal VSYNC− is a logical ONE (high voltage level) when information is being displayed on display screen 10 and in the logical ZERO (low voltage level) during the vertical retrace of the electron beam from the bottom scan line to the top scan line of display screen 10. In the preferred embodiment, resistor R9 is a 470 ohms resistor and again voltage V1 is +5 volts DC.

The logical states (ONE and ZERO) and their corresponding voltage levels of the modulated video (MVIDEO+), horizontal synchronization (HSYNC+), and vertical synchronization (VSYNC−) signals required by monitor electronics 79 are a function of the particular monitor electronics 79 employed within a given embodiment. In the preferred embodiment, modulated video signal MVIDEO+ is used by the monitor electronics to control one of the grids within CRT 11 to determine whether or not the display screen 10 is modulated to the light state or the dark state. The two brightness levels of dots on display screen 10 is achieved by biasing the video signal into a threshold region such that when a low intensity dot is required only a partial beam is generated by CRT 11. Horizontal synchronization signal HSYNC+ controls the horizontal deflection circuitry within the monitor electronics such that the electron beam is controlled to produce the horizontal scan lines and the horizontal retrace. The vertical synchronization signal VSYNC− drives the vertical deflection circuitry within monitor electronics 79 and controls the vertical deflection of the electron beam as the horizontal scan lines progress down the face of the CRT of the display screen 10 followed by the vertical retrace from the bottom to the top scan lines.

Before describing the characteristics of cable 81, it should be noted how the design of transmit logic 71 and receive logic 75 contribute to the minimization of the skew between the various signals. As discussed hereinbefore, subjective tests determined that the total amount of skew allowable in the transmission of the signals from the display controller 13 to the monitor electronics 79 was 16 nanoseconds. This total amount of 16 nanoseconds signal skew is composed of: the skew due to transmit logic 71, the skew due to cable 81, and the skew due to receive logic 75. Transmit logic 71 and receive logic 75 are designed to minimize skew by passing all transmitted signals through single integrated circuit elements and by choosing elements with fast switching times to minimize signal propagation delay. The use of single integrated circuits insures that all gates within the integrated circuit are as close to the same temperature and voltage level as possible. It should be noted that the temperature and the voltage level may vary from place to place on a printed circuit board and both temperature and voltage level will affect the switching times of the various gates within integrated circuits.

Passing all signals through this series of single integrated circuits also minimizes the difference in propagation delay in individual gates by using all gates within a single integrated circuit as opposed to using some gates in one integrated circuit for one signal and some gates in another integrated circuit for a second signal. For example, in the preferred embodiment, if the video synchronization register 70 was comprised of two parallel integrated circuits, as opposed to the one single integrated circuit actually used, and the video signal VIDDEO+ was input to one integrated circuit and the low intensity signal LOWINT+ was input to a second integrated circuit, there is the possibility that the skew between these two signals would be increased due to the different propagation delays introduced by the gates of the first integrated circuit with respect to those of the second integrated circuit.

This difference in propagation delay between the gates of separate integrated circuits is due to the process by which the integrated circuits are manufactured and the tolerances allowable for the propagation delay of a given integrated circuit type to still be within acceptable performance specifications. For example, a typical propagation delay time for switching from a low level to a high level output for the D-type flip-flops of video synchronization register 70 may be 8 nanoseconds with a maximum propagation delay of 12 nanoseconds. Therefore, if the video signal VIDDEO+ is being switched by a first integrated circuit with a typical propagation delay time of 8 nanoseconds and the low intensity signal LOWINT+ is being switched by a second integrated circuit with a propagation delay time of the maximum of 12 nanoseconds, the skew introduced between these two signals due simply to the fact that they are in two separate integrated circuits is 4 nanoseconds. This typical 30 to 50 percent difference in propagation delay between integrated circuits of the same type is eliminated by passing all signals through a single integrated circuit in which the propagation delay between gates within the same integrated circuit is in the range of less than 5 percent.

The use of single integrated circuits for all signals also has the secondary advantage in that it makes signal etch runs on the printed circuit boards of approximate equal length thereby minimizing the amount of skew due to different length signal runs. The skew is further reduced by integrated circuits with fast switching characteristics. For example, a 5 percent tolerance within an integrated circuit switching with a propagation delay time of 20 nanoseconds results in a possible one nanosecond skew between signals, whereas an integrated circuit with a propagation delay time of 10 nanoseconds results in a possible 0.5 nanosecond skew between signals.

In the preferred embodiment, there are two types of cable 81 used. For lengths of 0 to 75 feet, cable 81 is comprised of 4 pairs of twisted wires with an outer shielding around the four pairs of wires. For a cable length of 75 to 150 feet, cable 81 is comprised of four pairs of individually shielded wires with an outer shield around the four inner shields. In both these cases the outer shielding is grounded and primarily serves the purpose of reducing RFI emissions from the cable caused by the rapidly switching signals carried by the four twisted pairs. In both the short run, less than 75 feet, and the long run, over 75 feet, it is important that the length of the signal paths of the twisted pairs be approximately equal to minimize skew introduced by different signal path lengths.

In cable 81 of 75 to 150 feet, the individual twisted pairs of wires are individually shielded as illustrated in FIG. 6 to minimize the effect of signals in one pair switching in one direction (for example: high to low) and signals in another pair switching in the other direction (for example: low to high). Without shielding the individual pairs, a signal switching in one pair will speed up the switching of a signal in another pair switching in the same direction and will slow down the switching of a signal switching in the opposite direction in another pair. This reinforcing and inhibiting of switching between signals running in parallel conductors is caused by capacitance build-up in the cable and is a function of cable length. The shielding of individual twisted pairs helps reduce this capacitance build-up. Empirical tests, in which the skew due to transmit logic 71 and receive logic 75 have been accounted for, have shown that the individual shielding is not needed for cable lengths of less than 75 feet and is required for cable lengths of 75 to 150 feet.

Another factor determining the choice of cable and the maximum length which the cable is suitable is the capacitance of the pair of twisted wires itself. Capacitance increases with the length of the cable and directly affects the charging and discharging time of the signal levels. As the charging and discharging time increases, the signal wave shape, which would otherwise be a square wave, is distorted as the signal level charges up exponentially and discharges exponentially. This charging and discharging time introduced by cable capacitance delays a signal reaching the voltage level threshold required by the receiving circuit to switch from one state to another state. If all signals are switching at the same frequency, the charging and discharging time of each signal will be the same, and no skew will be introduced between the signals. However, a fast switching signal will not have time to fully charge or discharge the twisted pair and will result in the reaching of the threshold voltage level of the receiving circuit earlier than a signal switching at a lower frequency and thus introduce skew between the signals. For example, in the preferred embodiment, the video signals VIDDEO+CD and VIDDEO−CD can switch each dot time which is approximately 50.7 nanoseconds whereas the low intensity signals HGHLTE+CD and HGHLTE−CD may only switch at one-ninth that frequency (i.e., each character cell boundary, approximately 456.3 nanoseconds each), resulting in the fact that the cable capacitance can introduce skew between the video and low intensity signals. Thus the capacitance of the cable is a factor in determining the choice of cable.

Although the present invention has been described in terms of a remote monitor interface in which four signals are transmitted to receiver logic which combines two of them to produce three signals which are input to the monitor electronics, it is envisioned that many of the principles of the present invention could be employed with respect to a different number of signals being transmitted and a different number of signals being combined to produce a different number of output signals. For example, the present invention could be used with a multichrome display monitor with each color having multiple intensity levels. It is also envisioned that the present invention may be employed in other applications in which signal skew (missynchronization) must be minimized in the transmission of multiple signals. Additionally, it will occur to those skilled in the art that different register, driver, receiver and inverter circuits can be substituted without departing from the present invention.

While the present invention has been particularly described and shown with reference to the preferred embodiment, it will be understood by those skilled in the art that the foregoing and other changes in form, dimensions, and detail may be made herein without departing from the spirit and scope of the invention.

Having described the invention, what is claimed as new and novel and for which it is desired to secure Letters Patent is:

1. A method of communicating N different types of time-related information represented by a plurality of N binary information signals between a first device and a second device along a plurality of N parallel information channels comprising the steps of:

a. synchronizing all of said plurality of N binary information signals within said first device by use of a common clocking signal to produce a plurality of N synchronized binary information signals;

b. transmitting said plurality of N synchronized binary information signals by using a plurality of N drivers in said first device, each of said plurality of N drivers for driving one signal of said plurality of N synchronized binary information signals along one of said plurality of N parallel information channels;

c. receiving said plurality of N synchronized binary information signals by using a plurality of N receivers in said second device, each of said N receivers for receiving one signal of said plurality of N synchronized binary information signals from one of said plurality of N parallel information channels to produce a plurality of N received information signals;

d. amplifying each of said plurality of N received information signals by using one or more parallel amplifiers for each signal of said plurality of N received information signals to produce a plurality of N amplified information signals; and e. combining at least a first one of said plurality of N amplified information signals with at least a second one of said plurality of N amplified information signals to produce at least one modulated information signal comprising a plurality of M output information signals, wherein M is less than N and each of said plurality of M output information signals is either a one of said plurality of N amplified information signals or one of said at least one modulated information signals.

2. The method of claim 1 wherein said synchronizing step is performed using a plurality of N flip-flops, all of said plurality of N flip-flops having a common clocking signal and all of said plurality of N flip-flops being contained in one single integrated circuit.

3. The method of claim 2 wherein said transmitting step is performed using a balanced voltage driver chain for each one of said plurality of N drivers, each of said balanced voltage driver chains for outputting a pair of balanced signals on one of said plurality of N parallel information channels with each of said driver chains being contained in one single integrated circuit.

4. The method of claim 3 wherein said receiving step is performed using a balanced voltage receiver chain for each of said plurality of N receivers, each of said balanced voltage receiver chains for inputting one pair of said pairs of balanced signals from one of said plurality of N parallel information channels and for outputting one signal of said plurality of N received information signals and with each of said balanced voltage receiver chains being contained in one single integrated circuit.

5. The method of claim 4 wherein said amplifying step is performed by a single integrated circuit containing N or more amplifiers.

6. The method of claim 5 wherein said combining step is performed by using a resistor network to combine a plurality of said plurality of N amplified information signals to produce each of said at least one modulated information signals.

7. The method of claim 6 wherein said first device is a display controller and said second device is a display monitor and said plurality of N synchronized binary information signals are comprised of video information, intensity information, horizontal synchronization information and vertical synchronization information.

8. A method of communicating M different time-related information signals between a first device and a second device comprising the steps of:

a. retaining a plurality of N constituent binary information signals where N is greater than M and wherein one or more of said plurality of N constituent binary information signals can be combined to produce each of said M different time-related information signals;

b. synchronizing said plurality of N constituent binary information signals using a common clocking signal to produce a plurality of N synchronized binary information signals;

c. transmitting a plurality of N synchronized binary information signals from said first device to said second device over a plurality of N parallel information channels;

d. receiving said plurality of N synchronized binary information signals at said second device to produce a plurality of N received binary information signals;

e. amplifying said plurality of N received binary information signals to produce a plurality of N amplified information signals; and f. combining at least one of said plurality of N amplified information signals with at least one other of said plurality of said N amplified information signals to produce L modulated information signals which together with K of said plurality of N amplified information signals are used to comprise said M different time-related information signals and wherein K plus L equals M.

9. The method of claim 8 wherein said synchronizing step, said transmitting step, said receiving step, and said amplifying step are performed using a series of devices, each device of said series of devices comprising at least N parallel devices operating under substantially identical operating conditions and wherein each device of said at least N parallel devices is substantially identical.

10. The method of claim 9 wherein said substantially identical operating conditions and said substantially identical devices is provided by using a single integrated circuit for each device of said series of devices, each of said single integrated circuits comrising N or more parallel devices for synchronizing, transmitting, receiving, or amplifying, and by assuring that all signal paths contain the same number of devices and are of substantially identical length and capacitance.

11. The method of claim 10 wherein said transmitting step is performed using a plurality of N balanced voltage driver chains and said receiving step is performed using a plurality of N balanced voltage receiver chains and wherein the polarity of the outputs of said plurality of N balanced voltage driver chains is reversed with the polarity of the inputs of a corresponding one of said plurality of N balanced voltage receiver chains when required in order to eliminate the need of any individual inverters in said signal paths.

12. The method of claim 11 wherein said first device is a display controller and said second device is a display monitor and said plurality of N synchronized binary information signals are comprised of video information, intensity information, horizontal synchronization information and vertical synchronization information.

13. The method of claim 12 wherein said plurality of N parallel information channels is comprised of a plurality of N twisted pairs of conductors.

14. The method of claim 13 wherein each twisted pair of conductors of said plurality of N twisted pairs of conductors is individually shielded.

15. In a transmission system for communicating N different types of time-related information represented by a plurality of N time-related binary information signals between a first device and a second device said system comprising:

a. synchronizing means having inputs and outputs, included in said first device, for receiving said plurality of N binary information signals at said inputs of said synchronizing means and producing a plurality of N synchronized binary information signals at said outputs of said synchronizing means in response to a common clocking signal;

b. driving means having inputs and outputs, included in said first device with said inputs of said driving means coupled to said outputs of said synchronizing means, for driving said plurality of N synchronized binary information signals;

c. a plurality of N parallel information channels coupled to said outputs of said driving means and said second device;

d. receiving means having inputs and outputs, included in said second device with said inputs of said receiving means coupled to said plurality of N parallel information channels, for receiving said plurality of N synchronized binary information signals from said first device to produce a plurality of N received information signals;

e. amplifying means having inputs and outputs, included in said second device with said inputs of said amplifying means coupled to said outputs of said receiving means, for amplifying each of said plurality of N received information signals by using one or more parallel amplifiers for each of said plurality of N received information signals to produce a plurality of N amplified information signals; and f. combining means having inputs and outputs, included in said second device with said inputs of said combining means coupled to said outputs of said amplifying means, for combining at least one of said plurality of N amplified information signals with at least a second one of said plurality of N amplified information signals to produce at least one modulated information signal comprising a plurality of M output information signals, where M is less than N and each of said plurality of M output information signals is either a one of said plurality of N amplified information signals or one of said at least one modulated information signals.

16. The system of claim 15 wherein said synchronizing means is a plurality of N flip-flops, each of said plurality of N flip-flops having a common clocking signal and all of said plurality of N flip-flops being contained in one single integrated circuit.

17. The system of claim 16 wherein said driving means is a plurality of N balanced voltage driver chains, each of said plurality of N balanced voltage driver chains for having a pair of outputs for driving a pair of balanced voltage signals on one of said plurality of N parallel information channels with all of said plurality of N balanced voltage driver chains being contained in one single integrated circuit.

18. The system of claim 17 wherein said receiving means is a plurality of N balanced voltage receiver chains, each of said plurality of N balanced voltage receiver chains having a pair of inputs for receiving a pair of balanced voltage signals from one of said plurality of N parallel information channels with all of said plurality of N balanced voltage receiver chains being contained in a single integrated circuit.

19. The system of claim 18 wherein said amplifying means is a plurality of N or more amplifiers with all of said plurality of N or more amplifiers being contained in a single integrated circuit.

20. The system of claim 19 wherein said combining means is a resistor network.

21. The system of claim 19 wherein each of said single integrated circuits contain only one single substrate containing all active circuit elements thereby assuring that all devices in said single integrated circuits are substantially identical and operating under substantially identical operating conditions.

22. The system of claim 19 wherein the polarity of some of said pairs of outputs of said plurality of N balanced voltage driver chains is reversed with a corresponding one of said pairs of inputs of said plurality of N balanced voltage receiving chains thereby eliminating the need for a separate inverter device in any of the signal paths from said synchronizing means to said combining means.

23. The system of claim 22 wherein said amplifying means is also an inverting means.

24. In a display system including a first device for transmitting digital information including video character and control information signals to a second device for use in a cathode ray tube display monitor and in its connection system comprising:

a. a plurality of N parallel information channels;

b. transmitter means included in said first device for applying said video character and control information signals to said plurality of N parallel information channels, each different type of information being coded into a binary ONE or a binary ZERO state; and c. receiver means included in said second device coupled to said plurality of N parallel information channels for receiving said binary encoded video character and control information signals for distribution to a different predetermined number of output terminals included in said second device for subsequent processing by different portions of said display monitor.

25. The system as in claim 24 wherein said receiver means further comprises:

a. a plurality of N balanced voltage receiver chains having inputs and outputs, said inputs of said plurality of N balanced voltage receiver chains coupled to said plurality of N parallel information channels, each of said plurality of said N balanced voltage receiver chains for receiving one of said video character and control information signals; and b. amplifier means, having inputs and outputs, said inputs of said amplifier means coupled to said outputs of said balanced voltage receiver chains.

26. The system of claim 25 wherein said transmitter means further comprises:

a. a synchronizing means having inputs and outputs, said inputs of said synchronizing means for receiving said video character and control information signals, said synchronizing means for synchronizing said binary-encoded video character and control signals at said outputs of said synchronizing means; and b. a plurality of N balanced voltage driver chains having inputs and outputs, said inputs of said plurality of N balanced voltage driver chains coupled to said outputs of said synchronizing means and said outputs coupled to a plurality of N parallel information channels.

27. The system of claim 26 wherein said N parallel information channels are comprises of a plurality of N twisted pairs of conductors.

* * * * *